US005757393A

United States Patent [19]

Suzuki

[11] Patent Number: 5,757,393

[45] Date of Patent: May 26, 1998

[54] IMAGE RECORDING APPARATUS

[75] Inventor: Akio Suzuki, Yokohama, Japan

[73] Assignee: Canon Kabushiki Kaisha, Tokyo, Japan

[21] Appl. No.: 524,411

[22] Filed: Sep. 6, 1995

[30] Foreign Application Priority Data

Sep. 6, 1994 [JP] Japan ..... 6-212582

[51] Int. Cl.[6] ..... B41J 29/38; B41J 3/407

[52] U.S. Cl. ..... 347/16; 347/106

[58] Field of Search ..... 347/16, 14, 106, 347/107, 19, 105; 358/402, 444

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,855,753 | 8/1989 | Ichikawa et al. . | |
| 5,004,928 | 4/1991 | Suzuki et al. . | |
| 5,473,446 | 12/1995 | Perumal, Jr. et al. | 358/523 |
| 5,488,223 | 1/1996 | Austin et al. | 347/19 |

FOREIGN PATENT DOCUMENTS

| | | |
|---|---|---|
| 0488724 | 6/1992 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 62-196167 | 8/1987 | Japan . |
| 63-191661 | 8/1988 | Japan . |
| 1209162 | 8/1989 | Japan . |
| 1253454 | 10/1989 | Japan . |
| 5177887 | 7/1993 | Japan . |
| 6031967 | 2/1994 | Japan . |
| 6161321 | 6/1994 | Japan . |

*Primary Examiner*—Benjamin R. Fuller
*Assistant Examiner*—Thinh Nguyen
*Attorney, Agent, or Firm*—Fitzpatrick, Cella, Harper & Scinto

[57] ABSTRACT

An image processing parameter such as a masking coefficient is inputted by a key or bar code reader in accordance with a type of a recording medium. In a recording operation, color image data is processed in accordance with the input parameter and a color image is recorded on the recording medium based on the processed data. Thus, a high grade image is always formed without regard to the type of recording medium.

13 Claims, 4 Drawing Sheets

IMAGE RECORDING APPARATUS

BACKGROUND OF THE INVENTION

1. Field of the Invention

The present invention relates to an image recording apparatus which may be in the form of an image outputting terminal of an information processing apparatus such as a computer, a copying apparatus combined with a reader, a facsimile apparatus having transmission and reception functions, or a systemized printing apparatus for directly printing a picture pattern to cloth.

2. Related Background Art

Many ink jet type serial image recording apparatuses such as copying apparatuses facsimile apparatuses and printers have recently been commercialized because the ink jet system is one of low noise, non-impact type recording apparatus which discharges ink to directly deposit it on a recording sheet and the image recording apparatus using such ink jet type recording head allows a high density and high speed recording operation.

The image recording apparatus comprises a recording head, feed means for feeding a recording medium (recording sheet, cloth, plastic sheet, etc.) drive means for reciprocally moving the recording head transversely to the feed direction of the recording medium, and control means for controlling the discharge of the ink from the recording head, the feed and the drive means. The recording head for discharging the ink from a plurality of discharge ports is serially scanned transversely to the feed direction of the recording sheet (in a main scan direction) and during non-print operation, the recording sheet is intermittently fed by an amount equal to a recording width of the recording medium. In this recording method, the ink is discharged onto the recording medium in accordance with a record signal and the recording system is widely recognized as a low running cost and low noise recording system. By using the head having a number of nozzles for discharging the ink formed in a line perpendicular to the relative movement direction of the recording medium and the recording head, a width corresponding to the number of nozzles can be recorded in one scan of the recording head and the recording medium so that the high speed printing is attained.

An apparatus which mounts three to four color recording heads to form a full color image has been put into practical use. Such a color image recording apparatus uses a subtractive color mixing method. Namely, any color is generated by mixing three primary colors at an appropriate proportion. For example, when yellow and magenta are mixed, red is produced. When magenta and cyan are mixed, blue is produced. Various colors may be produced based on such three primary colors. Normally, in an ink jet type recording apparatus for forming a multi-color image by the serial scan system, three color recording heads, yellow, magenta and cyan (not restricted to this order) or further a black recording head to enhance hue, are mounted along the direction of movement of the recording head (in the main scan direction).

The versatility of the recording medium to be used in the image recording apparatus has recently been increased and the recording medium such as an OHP film or a glossy paper may be used in addition to an ordinary paper.

Normally, an optimum recording condition differs from medium to medium. For example, for the ink jet type image recording apparatus, an ability to absorb the ink differs from medium to medium, so the ink may overflow unless the amount of ink to be used for printing is changed. Since color development is also different, a color correction process need be changed. Since a thickness and a friction coefficient differ from medium to medium and a sheet feed property is different, a white stripe or a black stripe may appear at the joint of scans in the serial scan type recording apparatus unless the feed amount is changed for each scan. Accordingly, it has been proposed to prepare a plurality of image recording conditions for the respective recording media in the image recording apparatus so that a user may select an appropriate one at each operation, or there has been provided the image recording apparatus which automatically determines the type of recording sheet to select the image recording condition.

This approach may be sufficient When the recording media to be used are predetermined and the recording conditions therefore are preset in the image recording apparatus. However, a new recording tedium may be developed after the image recording apparatus has been marketed. In such a case, there is no other way than selecting one of the preset recording conditions in the recording apparatus. If it provides a sufficiently high quality image, no problem occurs, but if none of the recording conditions is sufficient, the new recording medium, however excellent it may be, cannot be put into the market until an image recording apparatus having the recording condition compatible to the new medium is developed and marketed.

It may be possible to select one of the preset conditions which provides a relatively highest quality of image, but in such a case, the ability that the recording medium possesses cannot by fully utilized.

SUMMARY OF THE INVENTION

It is an object of the present invention to provide an improved image recording apparatus in the light of the above problems.

It is another object of the present invention to provide an image recording apparatus which allows high grade image recording without regard to the type of recording medium.

It is still another object of the present invention to provide an image recording apparatus which allows high grade recording for a recording medium which is marketed after the apparatus has been marketed.

It is still another object of the present invention to provide an image recording apparatus which allows setting of an image recording condition compatible to a recording medium.

It is still another object of the present invention to provide an image recording apparatus which allows setting of an image processing parameter compatible to a recording medium.

The above and other objects of the present invention will be apparent from the following description and the accompanying drawings.

DETAILED DESCRIPTION OF THE PREFERRED EMBODIMENTS

An embodiment of the present invention is now explained with reference to the drawings.

Figure 1:
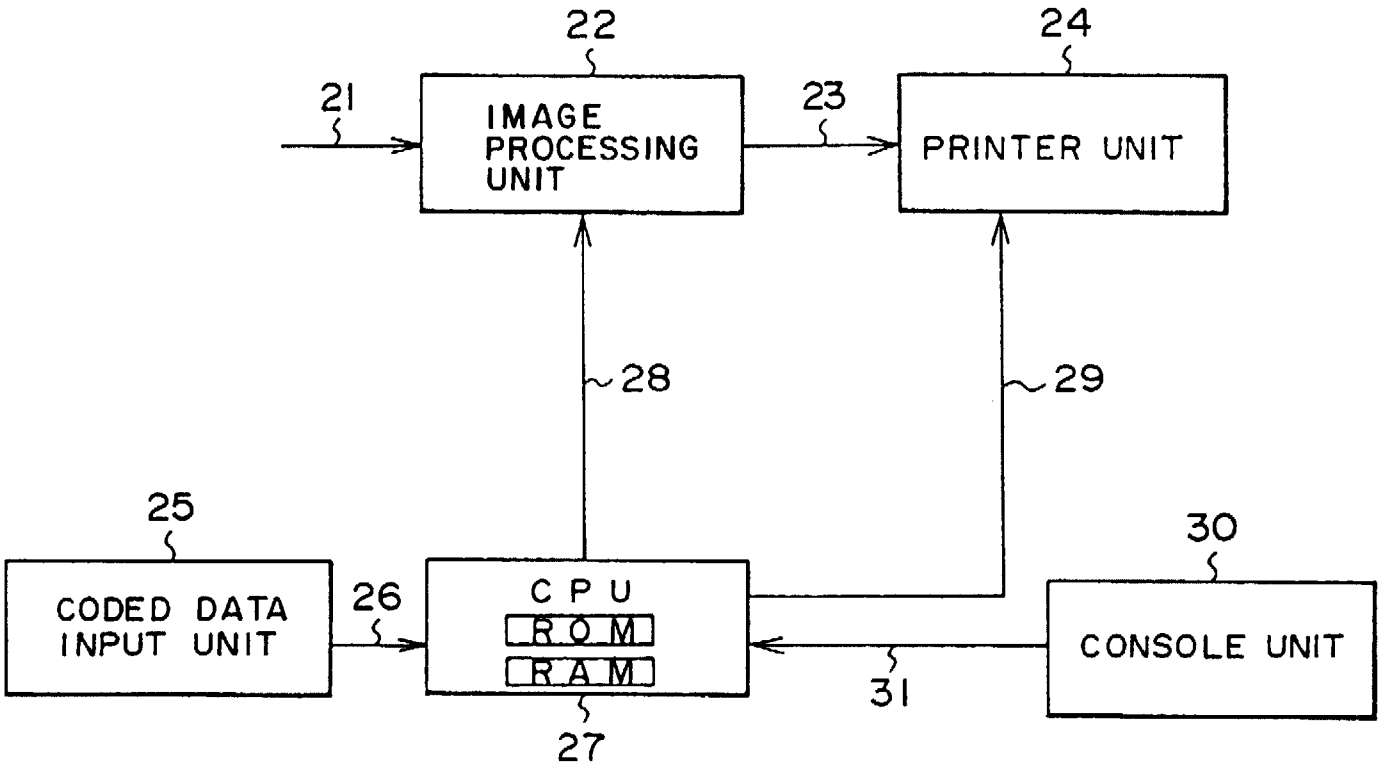
FIG. 1 shows a block diagram of a configuration of an image recording apparatus of the present invention.

FIG. 1 shows a block diagram of a configuration of a control unit of an image recording apparatus of the present invention. Numeral 21 denotes an image signal inputted to the image recording apparatus and comprises red, blue and yellow color signals, or cyan, magenta and yellow color signals sent from an information processing system, not shown, such as computer or image reader. The image signal is inputted to an image processing unit 22. Numeral 25 denotes an information input unit which has 16 keys 1 to F to allow the input of a hexadecimal number. A code number 26 representing a type of recording medium is inputted from the information unit 25 to a central processing unit (CPU) 27 having a ROM and a RAM. Numeral 36 denotes a console unit (or operation unit) which has various switches and a liquid crystal display panel to specify a document sheet size. Numeral 24 denotes a printer unit which outputs an image. In the present embodiment, an ink jet printer having a recording head of a type which discharges ink by causing a change of state in the ink by using thermal energy is used as will be explained later.

The image signal 21 in the image processing unit 22 is first explained.

The image signal 21 is inputted to the image processing unit 22 which conducts black extraction, UCR, masking process and others. For example, when the input signal comprises the three color signals, cyan, magenta and yellow (which are represented by $C_O$, $M_O$ and $Y_O$), $$K_O=\min.(C_O, M_O, Y_O)$$

is determined in the black extraction where K is a black signal.

Then, in the UCR process, $$C_1=C_O-b_1K_O$$
$$M_1=M_O-b_2K_O$$
$$Y_1=Y_O-b_3K_O$$
$$K_1=b_4K_O$$

are conducted.

Then, in the masking process, $$C_2=a_{11}C_1+a_{12}M_1+a_{13}Y_1+a_{14}K_1$$
$$M_2=a_{21}C_1+a_{22}M_1+a_{23}Y_1+a_{24}K_1$$
$$Y_2=a_{31}C_1+a_{32}M_1+a_{33}Y_1+a_{34}K_1$$
$$K_2=a_{41}C_1+a_{42}M_1+a_{43}Y_1+a_{44}K_1$$

are conducted, and in the gamma correction, $$C_3=c_1C_2$$
$$M_3=c_2M_2$$
$$Y_3=c_3Y_2$$
$$K_3=c_4K_2$$

are conducted.

$C_3$, $M_3$, $Y_3$ and $K_3$ are further binarized by an error spread method and it is outputted as a signal 23 from the image processing unit 22 to the printer unit 24.

In the above processing, $a_{11}$–$a_{44}$, $b_1$–$b_4$ and $c_1$–$c_4$ are constants which are optimized for a standard recording medium.

The printer unit to which the above signal 23 is applied is now explained.

Figure 2:
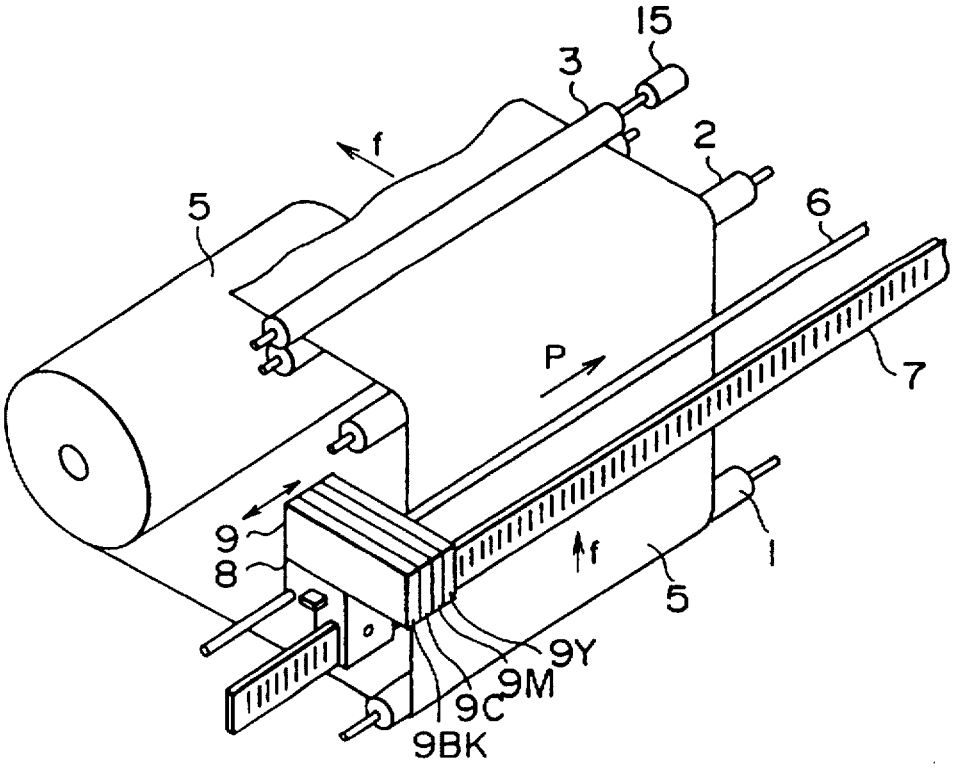
FIG. 2 shows a perspective view of a construction of a printer unit provided in the image recording apparatus of the present invention.

FIG. 2 shows a perspective view of a specific construction of the printer unit 24.

The rolled recording medium 5 is pinched by feed rollers 3 through feed rollers 1 and 2 and fed in a direction f as a sub-scan motor 15 coupled to the feed rollers 3 is driven. Guide rails 6 and 7 are arranged in parallel across the recording medium and the recording head unit 9 mounted on the carriage 8 is reciprocally moved laterally. The recording head unit 9 comprises four color heads, yellow, magenta, cyan and black, 9Y–9Bk. Accordingly, the four color heads, yellow, magenta, cyan and black are mounted on the carriage 8 and four color ink tanks are arranged thereto. The recording medium 5 is intermittently fed by the print width of the head 9 and while the recording medium 5 stops, the head is scanned in the direction P to discharge ink droplets in accordance with the image signal. The amount of intermittent feed may be adjusted by controlling the number of pulses supplied to the sub-pulse motor 15.

The recording heads 9Y–9Bk are ink jet recording means for discharging the ink by utilizing thermal energy and each of them is equipped with an electro-thermal transducer for generating the thermal energy. Those heads discharge the ink from the discharge ports by utilizing a change in pressure caused by growth and contraction of air bubbles by film boiling caused by the thermal energy applied by the electro-thermal transducer in order to print the image. Accordingly, the ink discharge ports may be arranged at a high density and a high resolution image may be produced. For example, in the present embodiment, the number of nozzles of the recording head is 256, the recording density is 400 dots/inch and the print width in the direction f is 16.256 mm. Namely, the image recording of 16.256 mm is repeated by the serial printer to output one sheet of image.

A process for forming the ink droplets in the bubble jet system conducted in such a head is now explained.

When a heat generating resistor (heater) reaches a predetermined temperature, film air bubbles are generated to cover a heater surface. An internal pressure of the air bubbles is so high that it drives out the inks in the nozzles. The ink is moved out of the nozzles into a common liquid chamber disposed oppositely by an inertia by the drive-out of the ink. As the ink is moved, the internal pressure of the air bubbles becomes negative and a flow path resistance is added thereto to lower the speed of the ink in the nozzles. Since the ink discharged from the nozzle ports (or discharge ports or orifices) has a lower speed than that in the nozzles, constrictions are formed by a balance between the inertia and the flow path resistance, the contraction of the air bubbles and the surface tensional force of the ink so that the ink is separated and formed into droplets. As the air bubbles are contracted, the ink is supplied into the nozzles from the common liquid chamber by a capillary action.

In the recording head using the electro-thermal transducer as the energy generation means, the air bubbles may be generated in the ink in each of the liquid paths corresponding to the driving electrical pulse signal and the air bubbles may be instantly and properly grown or contracted so that the high response ink droplet discharge may be attained. The compactness of the recording head is readily attained and the advantages of the IC technology and the micro-processing technology in which the advancement of the technologies in the recent semiconductor field is remarkable may fully utilized, and the high density packaging is facilitated and the manufacturing cost is low.

The use of the recording medium compatible to the standard specification of the apparatus which is set at the manufacture of the image forming apparatus of the present embodiment is now explained.

A code number is assigned to the recording medium by its type. The code number may be printed on an internal package of the recording medium. Numeral 25 in FIG. 1 denotes the information input unit which has 16 keys 1 to F to allow the input of a hexadecimal number.

In the present embodiment, a 18-digit hexadecimal number is assigned to the recording medium. The 18-digit number is represented by $X_1, X_2, X_3, X_4, \ldots, X_{16}, X_{17}, X_{18}$ in the descending digit order. $X_1$ is the data necessary to set $a_{11}$ of the constants for the masking process, and $X_2, X_3, \ldots X_{16}$ correspond to $a_{12}, a_{13}, \ldots, a_{44}$, respectively. $X_{17}$ corresponds to the number of pulses to be applied to the sub-scan motor 15. $X_{18}$ designates the address in the RAM of the CPU in which the information is to be inputted.

A specific example of the setting of the constants of the masking is now explained.

One hexadecimal number $X_1$ is 4-bit information and it corresponds to a positive number when the most significant bit is 0 and corresponds to a negative number when it is 1. The three low order bits correspond to an absolute value. When the three low order bits are 000, it corresponds to 0 and for each one bit increment, the number is incremented by 0.2 in the decimal notation. This is represented by a table as shown below.

set for the image recording. The contents of the ADR1–ADR3 are backed up even when the power supply of the machine is shut off and the information need not be re-set once it is set. In addition to the 18-digit information, the designation of one of the special sheets 1–3 is also printed on the package material of the recording sheet such that the special sheet 1 is designated for the recording sheet having 1 at the 18th digit, the special sheet 2 is designated for the recording sheet having 2 at the 18th digit, and the special sheet 3 is designated for the recording sheet having 3 at the 18th digit.

A procedure for actually operating the machine of the above construction is now explained.

When a recording medium other than the standard recording sheet is to be used for the first time, the code number of the recording medium is inputted from the information input unit 25. The special sheet button corresponding to the recording medium is depressed in the console unit 30 to start the image recording. When the recording medium of the same type is to be used next time, the code number need not be inputted again. By inputting the information to prepare, and set a new optimum recording condition, the machine may record the image on the recording condition optimized to the new recording medium even after the machine has been shipped to the market place.

| $X_N$ | 0 | 1 | 2 | 3 | 4 | 5 | 6 | 7 | 8 | 9 | A | B | C | D | E | F | (N = 1 ~ 16) |
|---|---|---|---|---|---|---|---|---|---|---|---|---|---|---|---|---|---|
| $a_{nn}$ | 0 | 0.2 | 0.4 | 0.6 | 0.8 | 1.0 | 1.2 | 1.4 | 0 | −0.2 | −0.4 | −0.6 | −0.8 | −1.0 | −1.2 | −1.4 | (n = 1 ~ 4) |

$X_{17}$ represents the information on the increment or decrement of the number of sub-scan feed pulses for the standard recording sheet. A specific example is shown in the list below.

| $X_{17}$ | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| Pulse Increment/ Decrement | 0 | +1 | +2 | +3 | +4 | +5 | +6 | +7 | 0 | −1 | −2 | −3 | −4 | −5 | −6 | −7 |

The CPU 27 converts the information in the manner described above and prepares the image recording condition for the recording medium corresponding to the information.

As described above, when the information is inputted, $X_{18}$ designates the address of the RAM in which the information is to be stored. For example, where there are three address areas for the information, the information is stored in a first address area ADR1 when the 18th bit is 1, and the information is stored in a second or third address area ADR2 or ADR3 when the 18th bit is 2 or 3, respectively.

Figure 3:
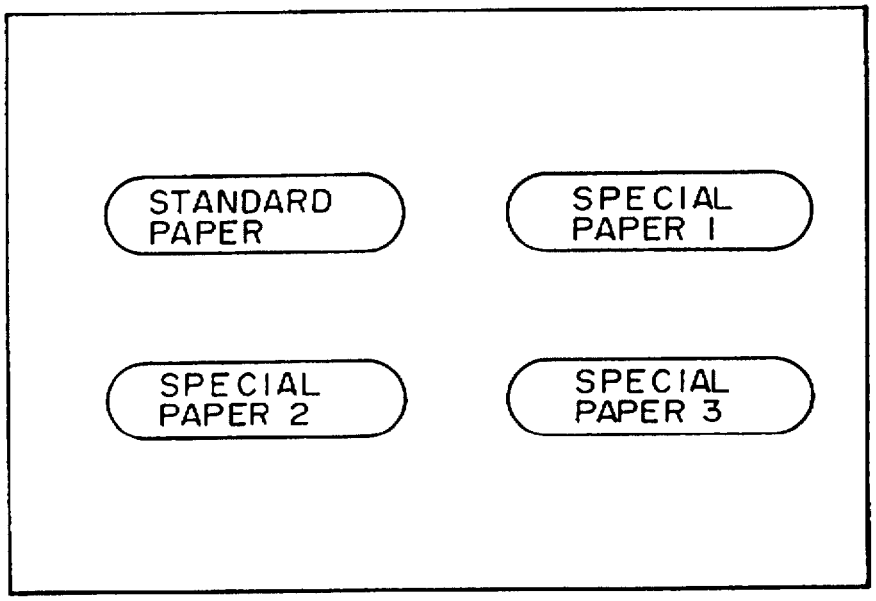
FIG. 3 shows a console unit provided in the image recording apparatus of the present invention.

The console unit 30 has a liquid crystal display screen and switches and designates a document sheet size, a print size, start of copy, a recording sheet, etc. In a selection mode of the recording medium, the liquid crystal screen as shown in FIG. 3 appears. A machine user depresses the type of the recording medium to be used to set the image recording condition of the machine. When a standard sheet is selected, the masking coefficient and the number of sub-scan pulses which are preset for the standard sheet are set. When another recording medium is to be used, the user selects special sheets 1–3. When the special sheet 1 is selected, the recording condition stored in the first address area ADR1 is set for the image recording. When the special sheet 2 is selected, the recording condition stored in the second address area ADR2 is set, and when the special sheet 3 is selected, the recording condition stored in the third address area ADR3 is

[Embodiment 2]

In the first embodiment, the input unit for inputting the information of the recording medium comprises 16 keys 1–F and the user manually inputs the information. In the present embodiment, the code information input unit 25 is a bar code reader which optically reads the information automatically.

A block diagram of the present embodiment is identical to that of FIG. 1 except that the information input unit is the optical bar code reader. Since the construction of the bar code reader is well known, it is not explained here. The information for the recording medium is printed on the package material not by digits but by bar code. When the user uses a particular recording material for the first time, the user reads the printed bar code by the bar code reader. Based on the read information, the CPU 27 prepares the masking coefficient and the number of sub-scan pulses in the same manner as that described in the first embodiment and stores them in the predetermined address ADR1–ADR3. Then, the recording conditions of the ADR1–ADR3 are set in accordance with the special sheet mode selected by the console unit 30 as they are in the first embodiment and the image is recorded at the condition compatible to the recording tedium.

In this manner, since the information is inputted by the bar code reader, complex information can be exactly read in a short time.

In the present embodiment, when the image recording apparatus is a copying apparatus having a document sheet reader, the document sheet reader may be used in place of the bar code reader. In this case, the package material on which the bar code is printed is mounted on the document sheet table and the bar code is read by the reader comprising the CCD. In such a case, the bar code need not be separately provided.

[Embodiment 3]

A third embodiment is now explained.

In the third embodiment, the information is printed on a non-image area of the recording medium and the machine automatically reads it to set the recording condition.

Figure 4:
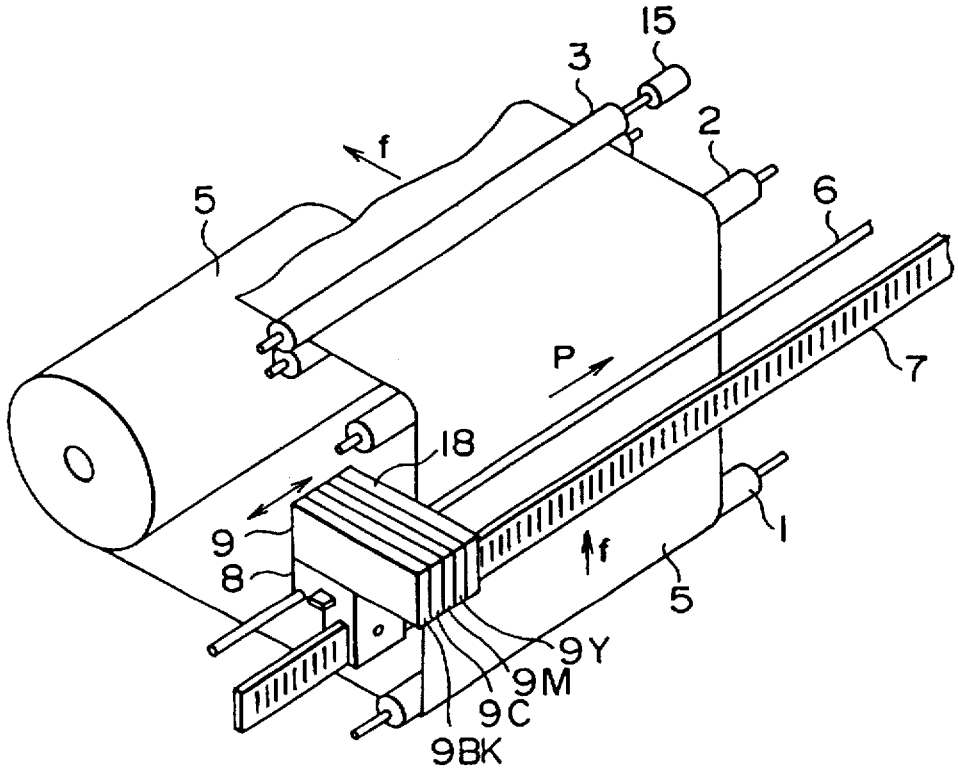
FIG. 4 shows a perspective view of a construction of a printer unit provided in the image recording apparatus of the present invention.
Figure 5:
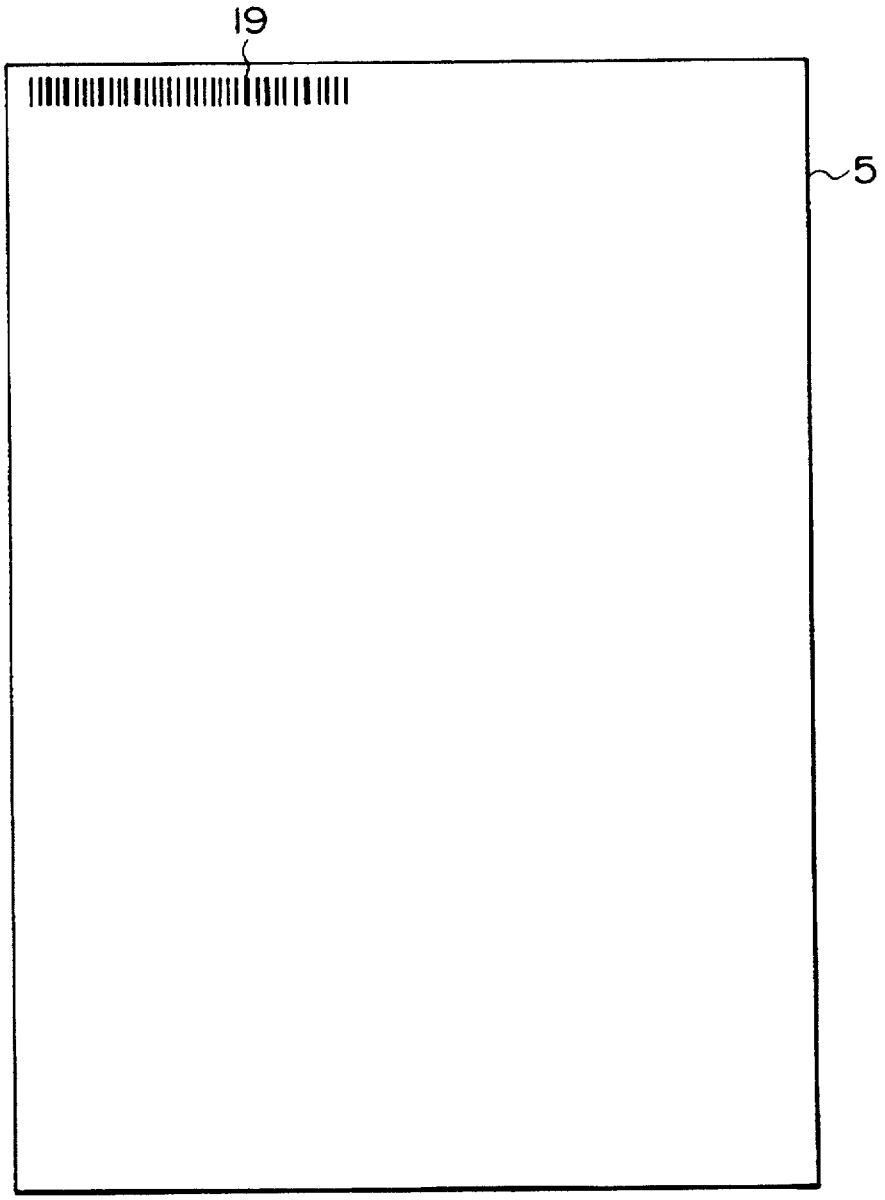
FIG. 5 shows an example of recording medium to be used in the image recording apparatus of the present invention.

FIG. 4 shows a perspective view of the printer unit used in the present invention. The like numerals to those shown in FIG. 2 denote the like elements. The printer used in the present embodiment mounts a read sensor 18 on the carriage 8. A recording medium used in the present embodiment is shown in FIG. 5. In the recording medium of the present embodiment, a bar code 19 is printed in a blank area on which the image is not to be recorded. When such recording medium is fed, the feed is temporarily stopped when the bar code reaches the position of the read sensor 18 and the read sensor 18 reads the bar code while the carriage 8 moves in the direction P. The read bar information is converted to the recording condition in the same manner as those described in the first and second embodiments and the image is recorded at that condition.

In this case, the user need not input the information of the recording material by the keys or select the type of the recording medium for each use thereof.

In the above embodiments, the information is imparted by the numeral or the bar code, but the present invention is not limited thereto. For example, punched holes may be provided in a blank area of the recording medium and the machine reads them. Any information may be used provided that the machine may prepare a new recording condition compatible to the recording medium when the information thereof is inputted to the machine.

The recording condition set in accordance with the recording medium is not limited to the masking coefficients and the number of sub-scan pulses. Alternatively, UCR coefficients $b_1$–$b_4$ or the gamma coefficients $c_1$–$c_4$ may be prepared.

This image recording apparatus is not limited to the ink jet type but the present invention is operable for a thermal transfer system, a sublimation dye type and an electrographic system. For example, when the present invention is implemented by the thermal transfer system or the sublimation dye type, the recording condition to be set in accordance with the information may include, in addition to the conditions set forth above, the amount of energy to be applied to the thermal head. For example, a table to convert an input image signal level to an energy to be applied to the head may be prepared in accordance with the information. When the present invention is implemented by the electrography, data such as document sheet exposure amount, photo-sensor exposure amount, photo-sensor charge amount, transfer current, developing bias condition of a developing unit, fixing temperature of a fixing unit and a rotation speed of a fixing roller may be set.

[Others]

The above embodiments specifically describe the image recording apparatus of the ink jet recording system which has means for generating the thermal energy (for example, electro-thermal transducer or laser) as the energy to be used to discharge the ink and causes the change in the state of ink by the thermal energy. This system attains the high density and fine recording.

The typical construction and the operational principles are preferably the ones disclosed in U.S. Pat. No. 4,723,129 and U.S. Pat. No. 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal providing such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of pulse because the development and the contraction of the bubbles can be effected instantaneously, and therefore the liquid (ink) is ejected with fast response. The driving signal is preferably such as those disclosed in U.S. Pat. No. 4,463,359 and U.S. Pat. No. 4,345,262. In addition, the temperature rise rate of the heating surface is preferably such as those disclosed in U.S. Pat. No. 4,313,124.

The structure of the recording head may be those shown in U.S. Pat. No. 4,558,333 and U.S. Pat. No. 4,459,600 in which the heating portion is disposed at a bent portion, as well as the structure of the combination of the ejection outlet, liquid passage and the electro-thermal transducer disclosed in the above-mentioned patents. In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port. This is because the present invention is effective to perform the recording with certainty and high efficiency irrespective of the type of the recording head.

The present invention is also effective to a full line type recording head having a length corresponding to a maximum width of the recording medium that the recording apparatus may record. Such a recording head may meet the length by a combination of a plurality of recording heads or a single recording head of an integral structure.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provisions of the recovery means and/or the auxiliary means for the preliminary operation are preferable because they further stabilize the effects of the present invention. As for such means, there are capping means for the recording head, cleaning means therefore, pressing or sucking means, and preliminary heating means which may be an electro-thermal transducer, an additional heating element or a combination thereof. Also, means for effecting preliminary discharge (not for the recording) may stabilize the recording operation.

Furthermore, in the foregoing embodiment, the ink is liquid. Alternatively, ink which is solidified below a room temperature and liquefied at a room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied. The present invention is applicable to other types of ink. In oe of them, the temperature rise due to the thermal energy is positively prevented by consuming it for the s tate change of the ink from the solid state to the liquid state. Another ink is solidified when it is left unused to prevent the evaporation of the ink. In any case, upon the application of the recording signal producing thermal energy, the ink is liquefied, and the liquefied ink may be discharged. Another ink may start to be solidified at the time when it reaches the recording sheet. The present invention is also applicable to the ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260.

While the invention has been described with reference to the structures disclosed herein, it is not confined to the details set forth and the present invention is intended to cover such modifications or changes as may come within the objects of the improvements or the scope of the claims.

What is claimed is:

1. An image recording apparatus comprising:

recording means for recording an image on a recording medium in accordance with input image data;

input means for inputting first information in accordance with a type of a recording medium;

register means for newly registering the first information inputted by said input means at a predetermined area of a memory means, wherein said memory means registers in advance at another area thereof second information according to a type of a recording medium;

select means for selecting appropriate information from the first information and the second information registered in said memory means; and setting means for setting a recording condition for the recording medium in accordance with the appropriate information selected by said select means.

2. An image recording apparatus according to claim 1, wherein the first information for the type of recording medium is represented by a bar code, numerals, punched holes, characters or symbols.

3. An image recording apparatus according to claim 1 or 2, wherein the first information for the type of recording medium is recorded on the recording medium.

4. An image recording apparatus according to claim 1 or 2, wherein the first information for the type of recording medium is recorded on a member associated with the recording medium.

5. An image recording apparatus according to claim 1, wherein the first information for the type of recording medium is represented by a bar code and said input means comprises a bar code reader.

6. An image recording apparatus according to claim 1, further comprising means for selecting one of plural types of the recording medium, wherein said recording means records the image at the image recording condition set in accordance with a result of selection by said selecting means.

7. An image recording apparatus according to claim 1, wherein said setting means comprises means for preparing a new image recording condition based on the first information inputted by said input means and said memory means stores the new image recording condition.

8. An image recording apparatus according to claim 1, wherein said recording means comprises processing means for processing the input image data and said input means inputs a parameter for processing by said processing means.

9. An image recording apparatus according to claim 8, wherein the processing comprises a masking process.

10. An image recording apparatus according to claim 1, wherein said recording means comprises feed means for feeding the recording medium and said input means inputs information on a feed amount of the recording medium by said feed means.

11. An image recording apparatus according to claim 1, wherein said recording means records a plurality of colors.

12. An image recording apparatus according to claim 1 or 11, wherein said recording means comprises an ink jet recording head for discharging ink droplets in accordance with the input image data.

13. An image recording apparatus according to claim 12, wherein said ink jet recording head discharging the ink droplets by causing a change of state in the ink by using thermal energy.

* * * * *

UNITED STATES PATENT AND TRADEMARK OFFICE

CERTIFICATE OF CORRECTION

PATENT NO. : 5,757,393 Page 1 of 2

DATED : May 26, 1998

INVENTOR(S) : SUZUKI

It is certified that error appears in the above-identified patent and that said Letters Patent is hereby corrected as shown below:

On the title page: Item

[56] References Cited:

FOREIGN PATENT DOCUMENTS

| | | |
|---|---|---|
| "1209162 | | --1-209162 |
| 1253454 | | 1-253454 |
| 5177887 | should read | 5-177887 |
| 6031967 | | 6-031967 |
| 6161321" | | 6-161321--. |

COLUMN 2:

Line 16, "When" should read --when--.

Line 19, "tedium" should read --medium--.

COLUMN 6:

Line 21, "prepare." should read --prepare--.

Line 62, "tedium." should read --medium--.

UNITED STATES PATENT AND TRADEMARK OFFICE

CERTIFICATE OF CORRECTION

PATENT NO. : 5,757,393

DATED : May 26, 1998

INVENTOR(S) : SUZUKI

It is certified that error appears in the above-identified patent and that said Letters Patent is hereby corrected as shown below:

COLUMN 9:

Line 7, "oe" should read --one--.

Line 9, "s tate" should read --state--.

Line 11, "unused" should read --unused,--.

Signed and Sealed this

Eighth Day of December, 1998

Bruce Lehman

*Attest:*

BRUCE LEHMAN

*Attesting Officer*

*Commissioner of Patents and Trademarks*